US011077582B2

(12) United States Patent
Lehtonen et al.

(10) Patent No.: US 11,077,582 B2
(45) Date of Patent: Aug. 3, 2021

(54) METHOD AND SYSTEM FOR RECYCLING CONCRETE MASS IN A SLIPFORM CASTING PROCESS, AND CASTING MACHINE

(71) Applicant: Elematic Oyj, Akaa (FI)

(72) Inventors: Heikki Lehtonen, Toijala (FI); Jouni Sirkka, Lempäälä (FI); Jani Eilola, Lempäälä (FI)

(73) Assignee: Elematic Oyj, Akaa (FI)

( * ) Notice: Subject to any disclaimer, the term of this patent is extended or adjusted under 35 U.S.C. 154(b) by 252 days.

(21) Appl. No.: 16/243,141

(22) Filed: Jan. 9, 2019

(65) Prior Publication Data

US 2019/0232523 A1 Aug. 1, 2019

(30) Foreign Application Priority Data

Jan. 30, 2018 (FI) ..... 20185081

(51) Int. Cl.

| | |
|---|---|
| ***B28B 1/00*** | (2006.01) |
| ***B28B 1/26*** | (2006.01) |
| ***B28B 11/12*** | (2006.01) |
| ***B28B 3/22*** | (2006.01) |

(52) U.S. Cl.

CPC ..... *B28B 1/26* (2013.01); *B28B 3/228* (2013.01); *B28B 11/12* (2013.01)

(58) Field of Classification Search

CPC ..... B28B 1/26; B28B 3/228

See application file for complete search history.

(56) References Cited

U.S. PATENT DOCUMENTS 3,423,492 A 1/1969 Jonell et al.
4,298,296 A * 11/1981 Hanson ..... F16L 1/038 134/166 R
4,784,518 A * 11/1988 Cutler ..... E01C 23/065 404/102

(Continued)

FOREIGN PATENT DOCUMENTS

CN 1683132 A 10/2005
EP 1134061 A1 9/2001

(Continued)

OTHER PUBLICATIONS

Finnish Patent and Registration Office, Search report of Finnish application No. 20185081, 2 pages.

(Continued)

*Primary Examiner* — Leith S Shafi
*Assistant Examiner* — Nicholas R Krasnow
(74) *Attorney, Agent, or Firm* — Meunier Carlin & Curfman LLC

(57) ABSTRACT

A method for recycling concrete mass in a slipform casting process, where the concrete mass is first cast and compacted with a slipform casting machine comprising a restricted cross-section to form a concrete product to be cast and at least one concrete mass tank for feeding concrete mass to the restricted cross-section, and the cast concrete mass is removed from areas of the fresh cast portion of the concrete product, wherein the removed fresh concrete mass is conveyed and dosed back to the at least one concrete mass tank of the slipform casting machine. The invention also relates to a system and a casting machine for implementing the method.

6 Claims, 2 Drawing Sheets

(56) References Cited

U.S. PATENT DOCUMENTS

| | | | | |
|---|---|---|---|---|
| 5,127,740 | A * | 7/1992 | DeBoer | B28C 5/00 220/504 |
| 5,401,115 | A * | 3/1995 | Musil | E01C 19/008 404/72 |
| 5,879,104 | A * | 3/1999 | Ulrich | E01C 19/407 404/102 |
| 2005/0084555 | A1* | 4/2005 | Jarvinen | B28B 7/30 425/64 |
| 2010/0260625 | A1* | 10/2010 | Drago | F04B 9/1172 417/410.3 |
| 2014/0042656 | A1* | 2/2014 | Schuran | B28B 15/002 264/37.19 |
| 2016/0115654 | A1 | 4/2016 | Pedersen et al. | |
| 2019/0153681 | A1* | 5/2019 | Christian | E01C 11/005 |
| 2020/0062647 | A1* | 2/2020 | Polak | C04B 40/0028 |
| 2020/0131720 | A1* | 4/2020 | McKinnon | B28B 13/0215 |

FOREIGN PATENT DOCUMENTS

| | | | |
|---|---|---|---|
| EP | 2559531 | A2 | 2/2013 |
| FI | 5417 | U1 | 7/2002 |
| GB | 1371908 | A | 10/1974 |
| GB | 1591348 | A | 6/1981 |

OTHER PUBLICATIONS

Elematicgroup, Elematic Hollow Core Slab Production Technology Feb. 2013 Youtube 720, Youtube video [online], published on May 2, 2013, [retrieved on Sep. 8, 2018] from Internet: <https://www.youtube.com/watch?v=LtsnrvpUbnE>, whole video, especially time frame 4:44-5:04.

Was 003-003: Offsite Construction Case Study, Waste Reduction Potential of Precast Concrete Manufactured Offsite, WRAP, pp. 7-9 and 11, published on: Dec. 4, 2011, [retrieved on Sep. 8, 2018] from Internet: <http://www.wrap.org.uk/sites/files/wrap/Pre-cast%20concrete%20-%20Full%20case%20study1.pdf>.

European Patent Office, Search report of European patent application No. EP19151304, dated Sep. 5, 2019, 3 pages.

Elematic, Elematic_Precast_Floor_Plant_video, Apr. 19, 2013, retrieved from internet at <https://www.youtube.com/watch?v=ZH-VIXZssAI>.

* cited by examiner

METHOD AND SYSTEM FOR RECYCLING CONCRETE MASS IN A SLIPFORM CASTING PROCESS, AND CASTING MACHINE

PRIORITY

This application is a U.S non-provisional patent application and claiming priority of Finnish application No. 20185081, filed on 30 Jan. 2018, the contents of all of which are incorporated herein by reference.

FIELD OF THE INVENTION

The present invention relates to recycling of cast concrete mass in a slipform casting process prior to curing of the concrete mass. More precisely the present invention relates to method and system for recycling a concrete mass removed from the fresh slipform cast concrete product before curing of the concrete mass, and to a casting machine for such a method and a system.

BACKGROUND OF THE INVENTION

Prefabricated concrete elements and products, such as hollow-core slabs and solid concrete slabs, are conventionally cast as slipform casting on elongate casting beds in a continuous casting process. The length of said continuous casting process is defined either on the basis of the combined length of the elements to be cast, or on the basis of the maximum length of the casting bed. The length of casting beds used in slipform casting can be up to 150-200 m, depending on the size of the element factory. After the slipform casting equipment has cast a continuous slab on the casting bed, the cast concrete mix is allowed to cure on the casting bed. When the concrete mix is cured, the uniform cast concrete slab is sawed in predetermined lengths on the basis of the targets of usage of the final elements, and the sawn concrete elements are lifted off the casting bed to storage, to wait for transportation to their respective locations of usage.

In slipform casting devices, concrete mix is fed either in one or several stages to a casting mold moving along with the casting device, said mold being formed by side walls of the mold and vibrating beam defining the top surface of the mold, together with the casting bed. The side walls and vibrating beam of the casting mold perform a vibrating and/or trowelling compacting motion for compacting the concrete product. When casting hollow-core slabs, the slipform casting device is provided with means for forming the cavities. Generally a slipform casting device is a casting machine moving on a stationary casting bed along with the casting process, but a slipform casting device can also be realized as a stationary casting station, in which case the casting bed moves along with the casting process with respect to the casting station. The two most common types of slipform casting methods are extruder and slipformer methods, wherein the extruder method concrete mix is fed in a single feeding stage to the slipform casting mold; and in the slipformer method the concrete mass is fed in two or more feeding stages to the slipform casting mold.

Generally concrete elements cast by slipform casting are prestressed, i.e. they are provided with reinforcing wires. Moreover, after slipform casting, the cast concrete elements can be provided with different apertures or cavities, for example for lead-ins or other required post-casting build-up of the elements. These apertures and/or cavities are typically formed by removing cast concrete mass from the fresh slipform cast concrete product at predefined locations, and the removal of the concrete mass is typically done during the slipfom casting process for the already cast portion of the slab.

The removal of concrete mass from the already cast portion of the fresh slipform cast concrete product can be done manually or with a finishing machine designed for finishing a fresh slipform cast concrete product before the concrete product cures. The finishing machines are typically provided with a ladle or a digging head, by which the machine makes holes and lead-throughs at predetermined spots of the cast concrete product. Conventionally such digging heads comprise two jaws, of which the first jaw is stationary, and the second jaw is movable in relation to the stationary jaw, so that the tip of the movable jaw is in the digging process turned towards the stationary jaw for detaching compact concrete mix and for removing it from the hole to be made.

One known solution for removing concrete mass from the fresh slipform cast concrete product is known from a Finnish utility model 5417, which comprises two separate machines, first one for breaking the upper surface of a cast hollow core slab and for compacting a solid section with lowered upper surface in the hollow core slab, and second one for creating dug-outs and depressions in the cast slab. The second machine comprises a digging unit for removing concrete mass from the fresh cast section of the slab, and a vertically movable bucket part for transferring the dug concrete mass to be reused with the first machine.

Another known solution for creating dug-outs and depressions in a fresh cast concrete product is to utilize suction machine to break the compacted concrete and to suck the concrete mass from the broken area of the fresh cast concrete product. In this solution it is not possible to reuse the removed concrete mass, since significant amounts of water is added to the removed concrete mass in order to get it flow through the suction hose making the removed concrete mass unusable slurry.

SUMMARY OF THE INVENTION

The present invention provides a solution for recycling concrete mass in a slipform casting process, where the concrete mass is removed from a cast portion of a fresh slipform cast concrete product. This recycling significantly decreases the waste concrete material created in the slipform cast process thus making the process more economical and environmentally friendly.

In the method of the invention for recycling concrete mass in a slipform casting process, where the concrete mass is first cast and compacted with a slipform casting machine comprising a restricted cross-section to form a concrete product to be cast and at least one concrete mass tank for feeding concrete mass to the restricted cross-section, the cast concrete mass is removed from areas of the fresh cast portion of the concrete product, and the removed fresh concrete mass is moved to a separate receiving bin in the slipform casting machine, from which receiving bin the removed concrete mass is conveyed and dosed back to the at least one concrete mass tank of the slipform casting machine.

In an embodiment of the method of the invention the removed fresh concrete mass is first transported to a conveyer system, which conveys the removed fresh concrete mass in smaller amounts to the at least one concrete mass tank of the slipform casting machine. This way the effect of the lower quality of the once cast concrete mass can be eliminated in the recycling process.

In the above embodiment of the method of the invention the conveyer system advantageously comprises a screw conveyer, and the removed fresh concrete mass is transported to one end of the screw conveyer and the screw conveyer doses the removed fresh concrete mass back to the at least one concrete mass tank of the slipform casting machine. Alternatively, the conveyer system may be implemented with a belt conveyer, or with a movable and tiltable skip, for example.

In an embodiment of the method of the invention small amounts of water may be added to the removed fresh concrete mass during its conveying and dosing back to the at least one concrete mass tank of the slipform casting machine. This improves the properties of the once cast concrete mass, and helps it to mix better with fresh concrete mass in the at least concrete mass tank of the slipform cast machine. However, the amounts of water to be added to the concrete mass needs to be sufficiently small, so that the quality of the concrete mass does not degrade significantly. Preferably no water is added to the removed concrete mass, but if water is added the water-to-cement ratio (w/c) of the removed concrete mass should not raise above 0.4-0.45.

In an embodiment of the method of the invention the removal of the concrete mass from the fresh cast portion of the concrete product is implemented with a digging tool of a finishing machine operating on the casting bed.

In an embodiment of the method of the invention the concrete mass from the fresh cast portion of the concrete product, and the conveying and dosing of the removed fresh concrete mass back to the at least one mass tank of the slipform casting machine are controlled with an automatic control system. The use of an automatic control system, among other benefits, allows measurement of time elapsed before the once cast concrete mass is returned to the at least one concrete mass tank of the slipform casting machine. This elapsed time data can be used to control the transportation of the concrete mass to be recycled to the at least one concrete mass tank. This also allows the removed concrete mass to be dosed to the at least one concrete mass tank at smaller portions during a preset time so that a new batch of removed concrete mass can be delivered to the conveyer system by the time previous batch has been dosed back to the at least one concrete mass tank, or before the removed concrete mass starts to set. This way the removed concrete mass to be recycled is mixed with a larger amount of fresh concrete mass in the concrete mass tank thus reducing its proportion in the mix, and the effect of recycled concrete mass for the quality of the cast concrete product is minimized.

The invention also provides a system for recycling concrete mass in a slipform casting process, which system comprises a slipform casting machine with at least one concrete mass tank, and a machine for removing concrete from the cast portion of a fresh slipform cast concrete product, wherein the slipform casting machine comprises a separate receiving bin for the removed concrete mass, to which the machine for removing concrete transport the removed concrete mass, and a conveyer for conveying and dosing the removed concrete mass from the receiving bin to the at least one concrete mass tank.

In an embodiment of the system of the invention the conveyer is a screw conveyer. Alternatively, the conveyer system may be implemented with a belt conveyer, or with a movable and tiltable skip, for example.

In an embodiment of the system of the invention the system comprises an automatic control system for controlling the slipform casting machine and the machine for removing concrete.

The invention also provides a casting machine for casting concrete products with a substantially horizontal slipform casting, which machine comprises a restricted cross-section defining the product to be cast, and elements for feeding concrete mass to the restricted cross-section comprising at least one concrete mass tank, and the machine further comprises a separate receiving bin for receiving concrete mass removed from a fresh slipform cast portion of a concrete product, and a conveyer for conveying and dosing the removed concrete mass from the receiving bin to the at least one concrete mass tank.

In an embodiment of the casting machine of the invention the conveyer is a screw conveyer. Alternatively, the conveyer system may be implemented with a belt conveyer, or with a movable and tiltable skip, for example.

In an embodiment of the casting machine of the invention the machine comprises devices for adding small amounts of water in the removed concrete mass before it is dosed in the at least one concrete mass tank.

The features defining a method of the invention are more precisely presented in claim 1, the features defining a system of the invention are more precisely presented in claim 8, and the features defining a casting machine of the invention are more precisely presented in claim 11. Dependent claims disclose advantageous features and embodiments of the invention.

BRIEF DESCRIPTION OF THE DRAWINGS

In the following an embodiment of the invention is discussed in greater detail in the sense of example and with reference to accompanying drawings, where FIGS. 1A-2B show schematically an embodiment of the invention.

In the figures is shown an embodiment of the invention, which comprises a slipform casting machine 1 and a finishing machine 2 on a casting bed 3. FIG. 1A shows the machines in normal operational mode as a sideview, FIG. 2B shows the situation of FIG. 2A as a 3D view.

DETAILED DESCRIPTION OF THE INVENTION

Figure 1A:
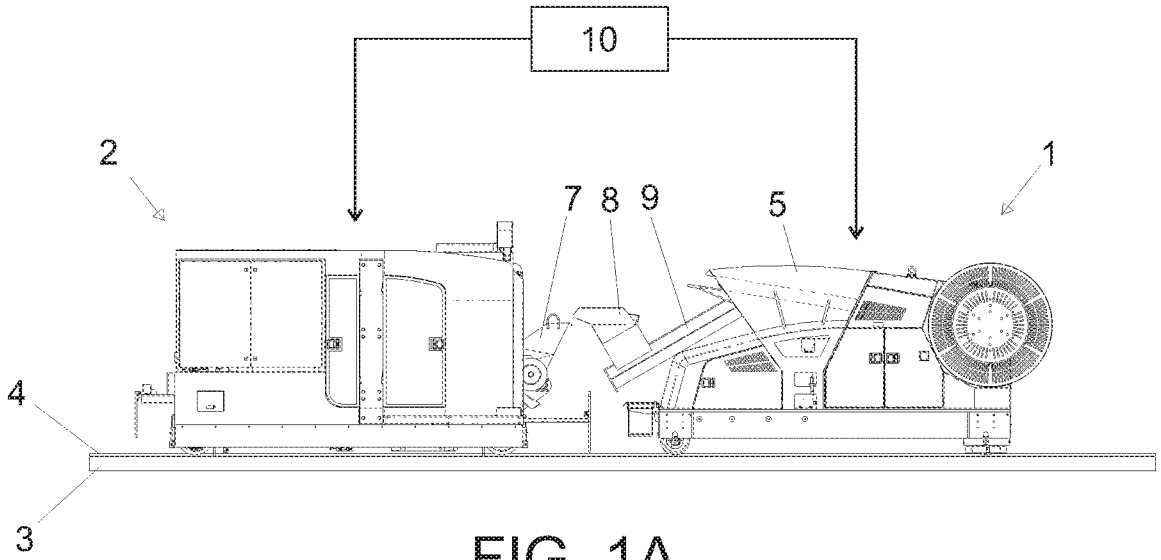
Figure 1B:
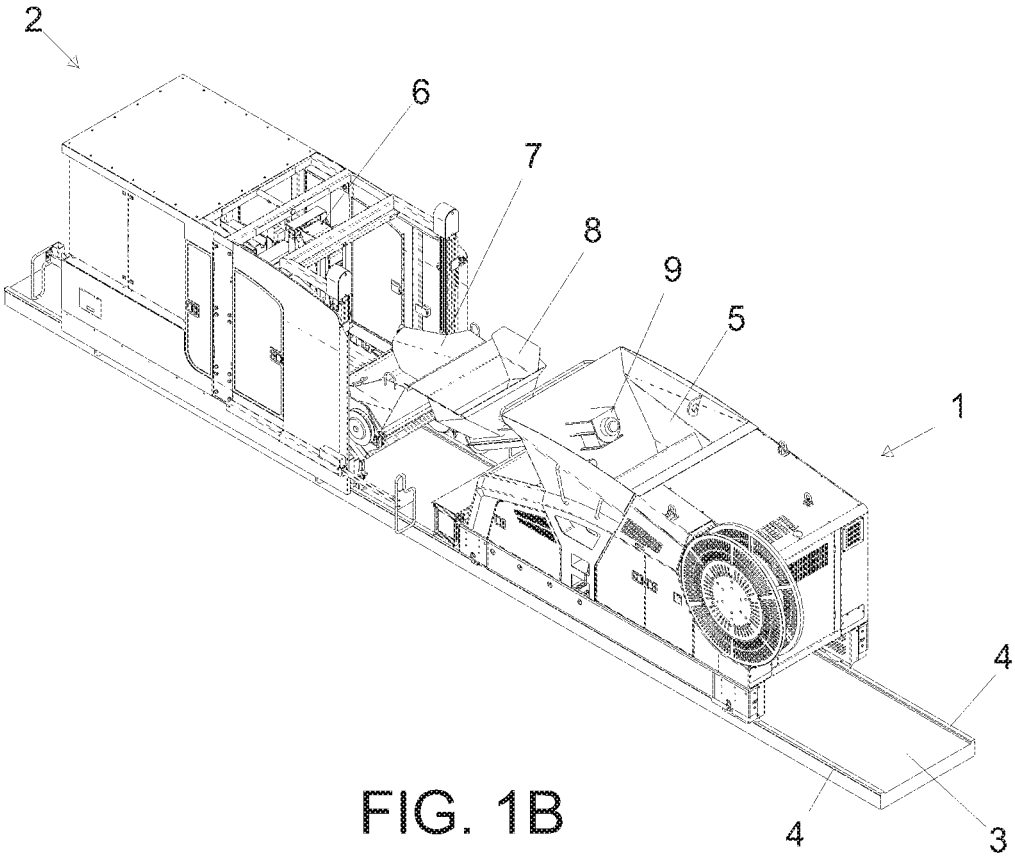
FIG. 1B shows the situation of FIG. 1A as a 3D view.

The casting machine 1 shown in the embodiment of figures is an extruder-type slipform casting machine comprising a concrete mass tank 5 from which the concrete mass is fed to feed screws inside the casting machine, which feed screws extrude the concrete mass under pressure to a restricted cross-section defining the cross-sectional dimensions of the concrete product to be cast. The compaction effect of the troweling and/or vibrating motion of the surfaces of the restricted cross-section together with the feed pressure of the feed screws compacts the concrete to very dense state, so that the fresh cast concrete product section exiting from the slipform casting machine 1 stays at its form on the casting bed 3 without any other supports. The casting machine 1 proceeds along the casting bed 3 on rails 4 due to the reaction force of the feed screws assisted with additional drive motor of the casting machine, when necessary.

On ready cast portion of the slipform cast concrete product exiting from the casting machine 1 operates the finishing machine 2, which also moves along the same rails 4 on both side of the casting bed 3. The finishing machine 2 comprises a digging arrangement 6 fixed movably to the frame of the finishing machine with a suitable digging head for digging holes and lead-throughs at predetermined places on the slipform cast fresh concrete product. One known type digging head is disclosed in EP 2 559 531, for example.

Once the concrete mass is removed from the fresh cast portion of the concrete product with the digging head, the digging arrangement 6 moves the removed concrete mass to a bucket 7, which bucket is connected vertically movably and turnably around horizontal turning axis to the frame of the finishing machine 2.

Once the bucket 7 is full, or when maximum predefined time has passed from the first removal of concrete mass from the fresh cast portion of the concrete product, or from previous emptying of the bucket, the finishing machine 2 moves next to the slipform casting machine 1 for emptying the bucket 7.

Figure 2A:
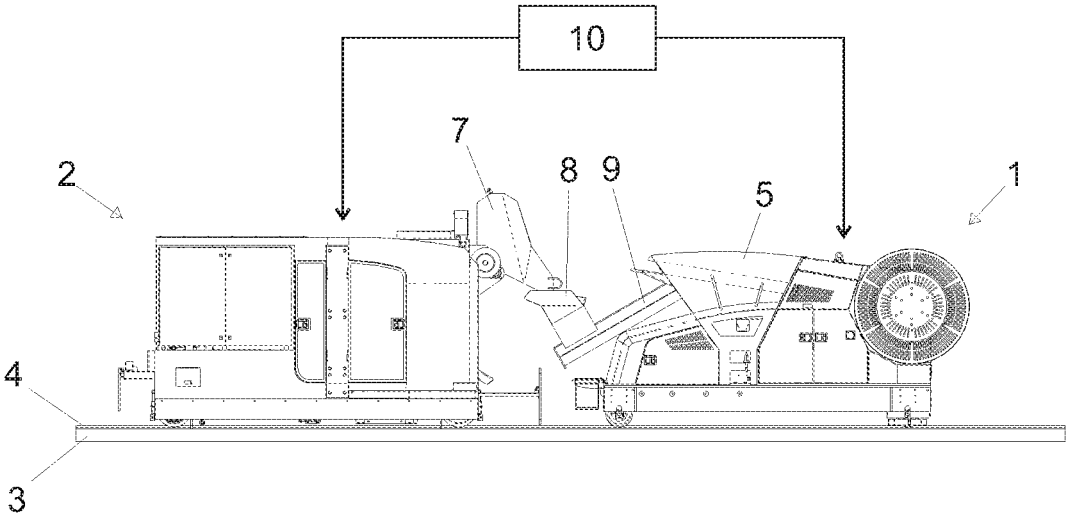
FIG. 2A shows the machines in a concrete mass transfer mode as a sideview.
Figure 2B:
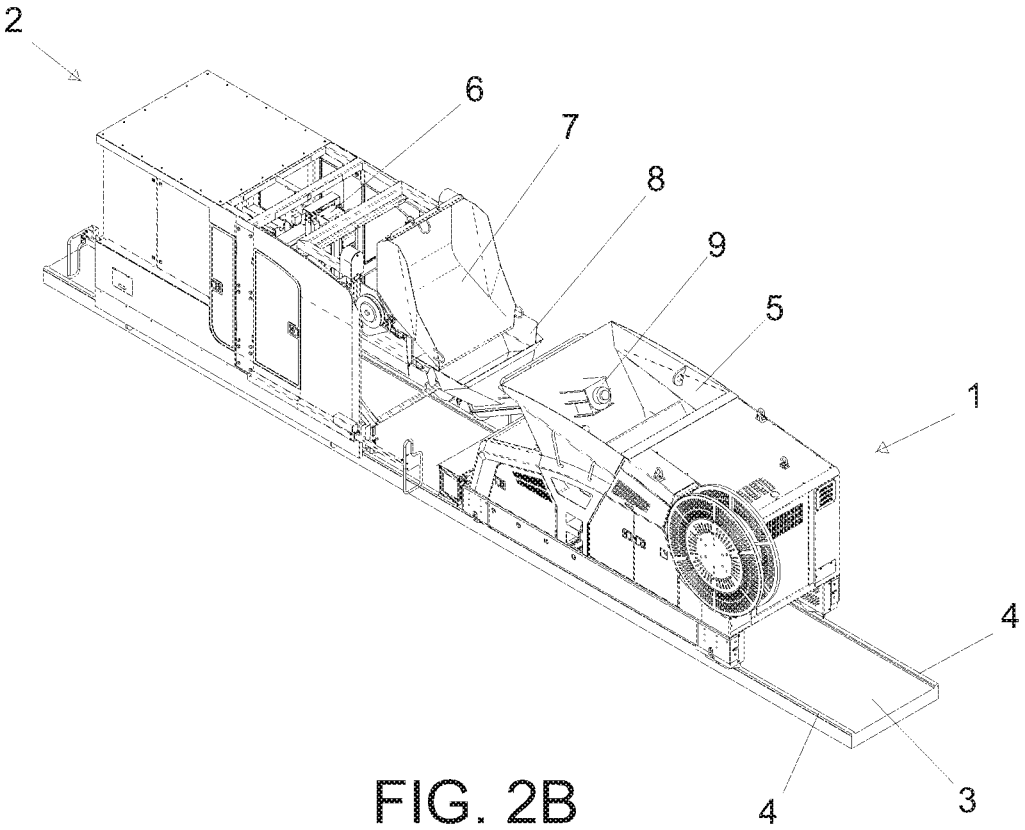

When the finishing machine 2 has reached the predetermined position in relation to the casting machine 1, the bucket 7 is raised at its maximum height, and turned in relation to its vertical turning axis, as shown in FIGS. 2A and 2B, so that the removed concrete mass collected therein will drop out of the bucket. Since the casting machine 1 continuously slowly proceed with the casting, the finishing machine 2 may also follow the movement of the casting machine during emptying of the bucket 7. Once the bucket 7 is emptied, the finishing machine will return to continue its finishing operations.

For receiving the collected concrete mass from the bucket 7 of the finishing machine 2, the casting machine 1 is equipped with a receiving bin 8, which receiving bin 8 is located at the longitudinal end area of the casting machine 1 to facilitate this transfer of removed concrete mass from the finishing machine 2 to the casting machine 1.

At the bottom area of the receiving bin 8 there is an open first end of a screw conveyer 9. The screw conveyer 9 extends from the bottom area of the receiving bin 8 to inside of the upper area of the concrete mass tank 5, where an open second end of the screw conveyer is located.

Removed concrete mass in the receiving bin 8 drops to the bottom area of the receiving bin and enters to the screw conveyer 9 through its open first end. The screw conveyer 9 conveys and doses the removed concrete mass from the receiving bin 8 to the concrete mass tank 5 of the casting machine 1. The amounts of removed concrete mass to be dosed to the concrete mass inside the concrete mass tank 5 can be controlled by changing the rotating speed of the screw inside the screw conveyer 9.

The receiving bin 8 and/or the screw conveyer 9 may be equipped with suitable watering arrangement with nozzles for spraying a small amounts of water to removed concrete mass before it is dosed to the concrete mass tank 5 of the casting machine 1.

Both the casting machine 1 and the finishing machine 2 are advantageously controlled with the same automatic control system 10, or the automatic control systems of these machines are advantageously connected to each other, so that all of the above described actions can be automatized without human interaction.

In addition to the extruder-type embodiment shown in figures and discussed above, the present invention can be implemented to any slipform casting apparatus comprising at least one concrete mass tank, such as a slipformer-type casting machine for example.

The specific exemplifying embodiment of the invention shown in figures and discussed above should not be construed as limiting. A person skilled in the art can amend and modify the embodiment in many evident ways within the scope of the attached claims. Thus, the invention is not limited merely to the embodiment described above.

What is claimed is:

1. A method for recycling concrete mass in a slipform casting process, comprising:

casting and compacting the concrete mass with a slipform casting machine comprising a restricted cross-section to form a concrete product to be cast and at least one concrete mass tank for feeding concrete mass to the restricted cross-section, removing the cast concrete mass from areas of a fresh cast portion of the concrete product with a digging arrangement of a finishing machine operating on a casting bed, wherein the removed fresh concrete mass is moved to a separate receiving bin in the slipform casting machine, from which the removed fresh concrete is conveyed and dosed back to the at least one concrete mass tank of the slipform casting machine.

2. The method according to claim 1, wherein the removed fresh concrete mass is first transported to a conveyer system, which conveys the removed fresh concrete mass to the at least one concrete mass tank of the slipform casting machine.

3. The method according to claim 2, wherein the conveyer system comprises a screw conveyer, and the removed fresh concrete mass is transported to one end of the screw conveyer and the screw conveyer doses the removed fresh concrete mass back to the at least one concrete mass tank of the slipform casting machine.

4. The method according to claim 1, wherein water is added to the removed fresh concrete mass during its conveying and dosing back to the at least one concrete mass tank of the slipform casting machine.

5. The method according to claim 1, wherein the removal of the concrete mass from the fresh cast portion of the concrete product, and the conveying and dosing of the removed fresh concrete mass back to the at least one concrete mass tank of the slipform casting machine are controlled with an automatic control system.

6. The method according to claim 2, wherein the conveying of the removed fresh concrete mass to the conveyer system and dosing of the removed fresh concrete mass to the at least one concrete mass tank is implemented in a time frame, which time frame is shorter than the setting time of the removed concrete mass.

* * * * *